US005115869A

United States Patent [19]

Flavio

[11] Patent Number: 5,115,869

[45] Date of Patent: May 26, 1992

[54] APPARATUS FOR EXTINGUISHING OIL WELL FIRES AND SEPARATING OIL/GAS STREAMS THEREOF

[75] Inventor: Dobran Flavio, 21 St. & Broadway, Long Island City, N.Y. 11106

[73] Assignee: Flavio Dobran, Long Island City, N.Y.

[21] Appl. No.: 690,663

[22] Filed: Apr. 24, 1991

[51] Int. Cl.[5] ..... A62C 3/06

[52] U.S. Cl. ..... 169/69; 169/48; 169/52

[58] Field of Search ..... 169/69, 43, 46, 52, 169/48

[56] References Cited

U.S. PATENT DOCUMENTS 1,807,498 5/1931 Teed ..... 169/69 X 1,859,606 5/1932 Sievern et al. ..... 169/69 X

*Primary Examiner*—Margaret A. Focarino

*Assistant Examiner*—Andrew C. Pike

[57] ABSTRACT

A very simple, safe, and robust device for extinguishing oil well fires consists of an inclined duct which is connected to a vertical duct placed over an oil well fire, and of suitably arranged baffles which are inserted into the inclined dust for redirecting or separating the oil and gas streams. The purpose of the inclined duct is to separate the oil and gas from the two-phase mixture which is produced by a burning well and consequently to decrease the oil evaporation area or volume of combustible gas and starve the fire when the air inflow from the bottom into the vertical duct is reduced or eliminated. The fire-extinguishing device contains only baffles as moving parts which can be operated remotely through pulleys. The separated oil stream can be discharged into the atmosphere or collected into a holding tank until the next phase of work associated with capping of the oil well is initiated, thus reducing the environmental pollution problems and creating a safe zone for personnel to work. The apparatus can be easily constructed and assembled in the field and placed over the burning fire by a bulldozer or crane. By changing the size of the apparatus by proportional scaling of dimensions it is possible to extinguish many different types of oil well fires.

4 Claims, 7 Drawing Sheets

VIEW 5-5 IN FIG. 4

VIEW 6-6

APPARATUS FOR EXTINGUISHING OIL WELL FIRES AND SEPARATING OIL/GAS STREAMS THEREOF

BACKGROUND OF THE INVENTION

1. Field of the Invention

The invention relates to the art of fighting oil well fires whereby these fires can be extinguished by an apparatus which reduces the oil evaporation area and starves the combustible gas with oxygen.

2. Background Art

An oil well fire can be characterized by a burning oil jet issuing from a cylindrical tube which is connected to an underground oil reservoir. Depending on the oil jet velocity, the jet and flame fronts can assume different configurations. The oil burns in a reaction zone surrounding the oil jet which consists of the evaporated oil, air, and evaporating oil droplets. The flame surface separates the reaction zone from the atmosphere and can assume various shapes depending on the laminar (low velocity) or turbulent (high velocity) characteristics of the jet. The higher the oil jet velocity the more intensive will be the mixing between the fuel (oil) and oxidizer (oxygen in the air) and thus more intensive the fire. A burning oil well can thus be viewed as a two-phase flow mixture of oil and gas and can be extinguished if the oxygen or air supply is terminated to the reaction zone. FIG. 1 illustrates schematically a burning oil well fire over which is placed a cylindrical guiding duct 5. As shown in this figure, the radial extent of the flame surface 4 an be controlled if the guiding duct radius R is not very large, since then the flame surface will extend to the wall of the duct and form an under-ventilated system with the reaction zone 3 enclosed by the oil jet and the duct wall.

To contain the reaction zone or decrease the oil burning rate it is necessary to decrease the area for oil evaporation and the supply of air to the reaction zone. The decrease of surface area for oil evaporation can be accomplished by an inclined plate separator where the oil and gaseous phases are separated from a two-phase mixture. This separator is illustrated in FIG. 2 and consists of an inclined duct 6 which is attached to the guiding duct 5 covering an oil well fire. The purpose of inclining the duct 6 is to take advantage of different inertias of oil and gas. The oil jet and droplets entrained in the gas will have a tendency to travel in a vertical direction due to their large inertias and therefore to strike the upper surface of the duct 6 and flow along this surface. The gaseous phases, consisting of the unburnt air, evaporated fuel, and combustion gases, will be displaced towards the lower surface of the inclined duct 6, and by providing the exit of the duct 6 with a baffle 9 (FIG. 2) the gas stream can be separated from the oil stream. If the air supply at the bottom of the guiding duct 5 is now diminished or eliminated by lowering the apparatus towards the ground 10 and baffle 9 suitably adjusted by closing the gas stream duct 8 it is clear that the fire will be starved of oxygen supply and the fire will be extinguished. Instead of lowering the apparatus towards the ground it is possible to equip the holding duct 5 at the bottom with injectors of neutral gas, such as nitrogen, which will substitute or prevent the air entrainment and thus provide a starvation of oxygen in the reaction zone of the apparatus.

SUMMARY OF THE INVENTION

The oil well fire extinguishing apparatus utilizes the basic principles of reducing the oil evaporation area, which reduces the volume of combustible gas in the system, and oxygen supply to the reaction zone. It consists of a vertical duct which is placed over a burning oil well fire and of an attached inclined duct. The purpose of the inclined duct is to separate the oil from the gas into separate streams flowing in the duct. Once the oil and the gas phases have been separated and the oil evaporation area significantly reduced, the fire can then be extinguished more easily. The redirection of the oil and gas streams from the inclined duct into separate paths is accomplished by baffles situated at the end of the inclined duct. These baffles are controlled externally from the apparatus and can be affected manually by turning pulleys or mechanically by motors. The redirected oil stream can be conveniently collected in a holding tank until the well is capped with a closing valve or discharged into the atmosphere far form the well, thus allowing the fire fighting team to work in the proximity of the well during the well repair stages. The oil well fire extinguishing apparatus can be constructed and assembled in the field by welding pre-fabricated metal plates and can be laced over a burning well by a bulldozer or crane. The apparatus is very simple and robust, and one particular geometry can be used to extinguish many different types of oil well fires.

DETAILED DESCRIPTION OF THE PREFERRED EMBODIMENT

Figure 1:
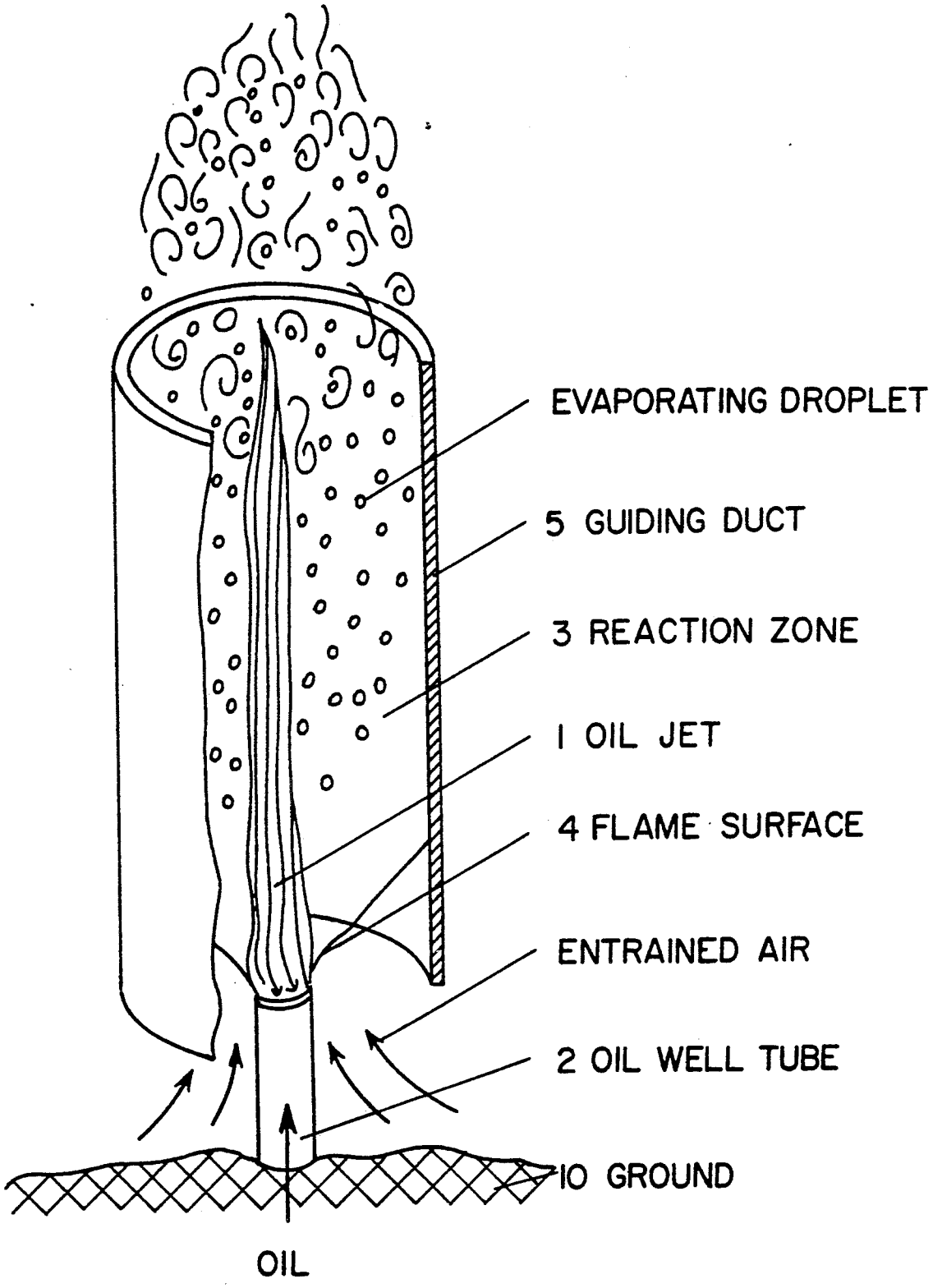
FIG. 1 PRIOR ART
FIG. 1 is a schematic and prior art of an oil well fire, illustrating the oil jet, flame surface, reaction zone, and the confinement of the flame by placing a cylindrical duct over the fire.
Figure 2:
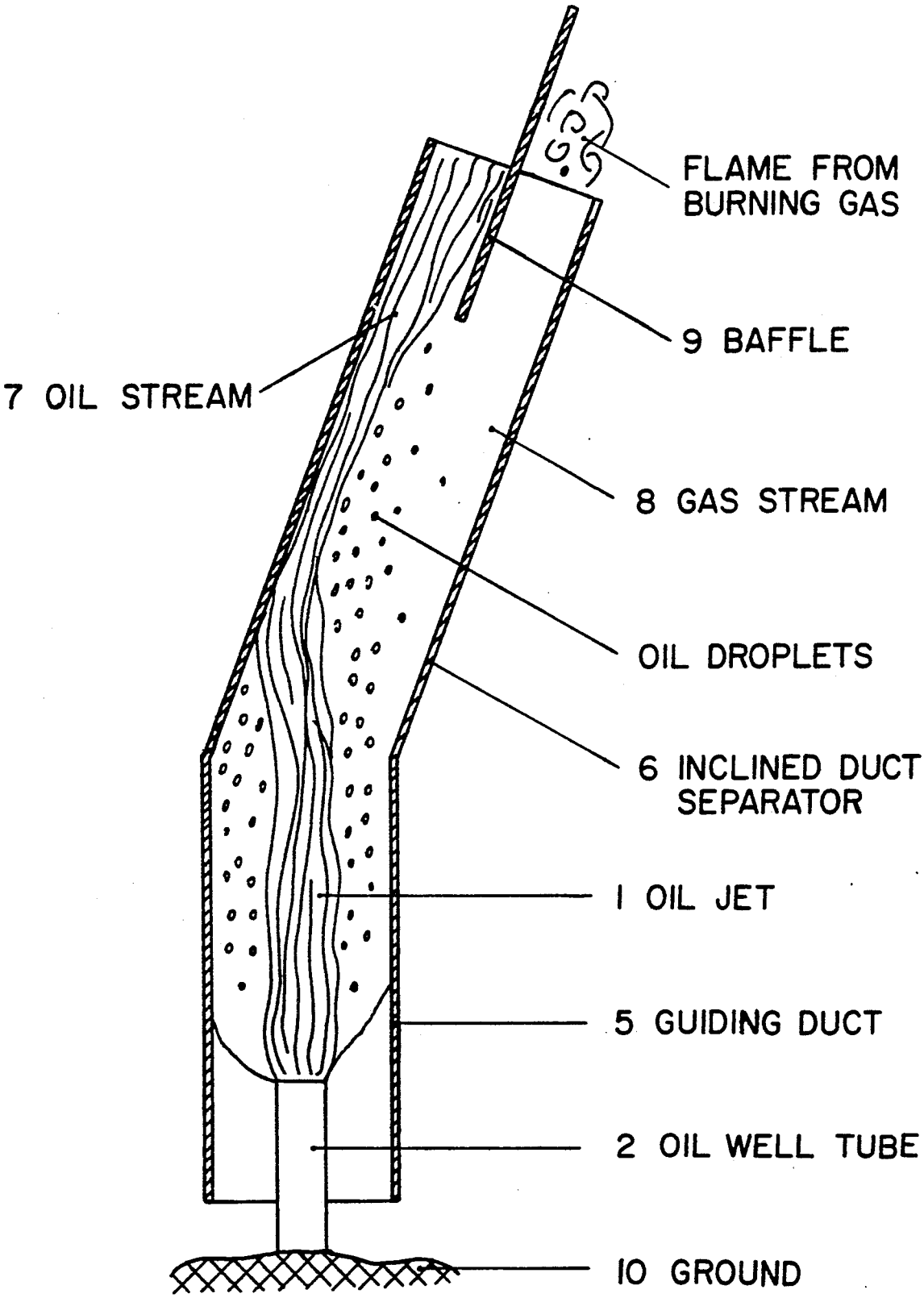
FIG. 2 illustrates the principle of reducing the oil evaporation area by separating the oil and gas from the two-phase mixture above the oil well tube by attaching an inclined duct to the guiding duct.
Figure 3:
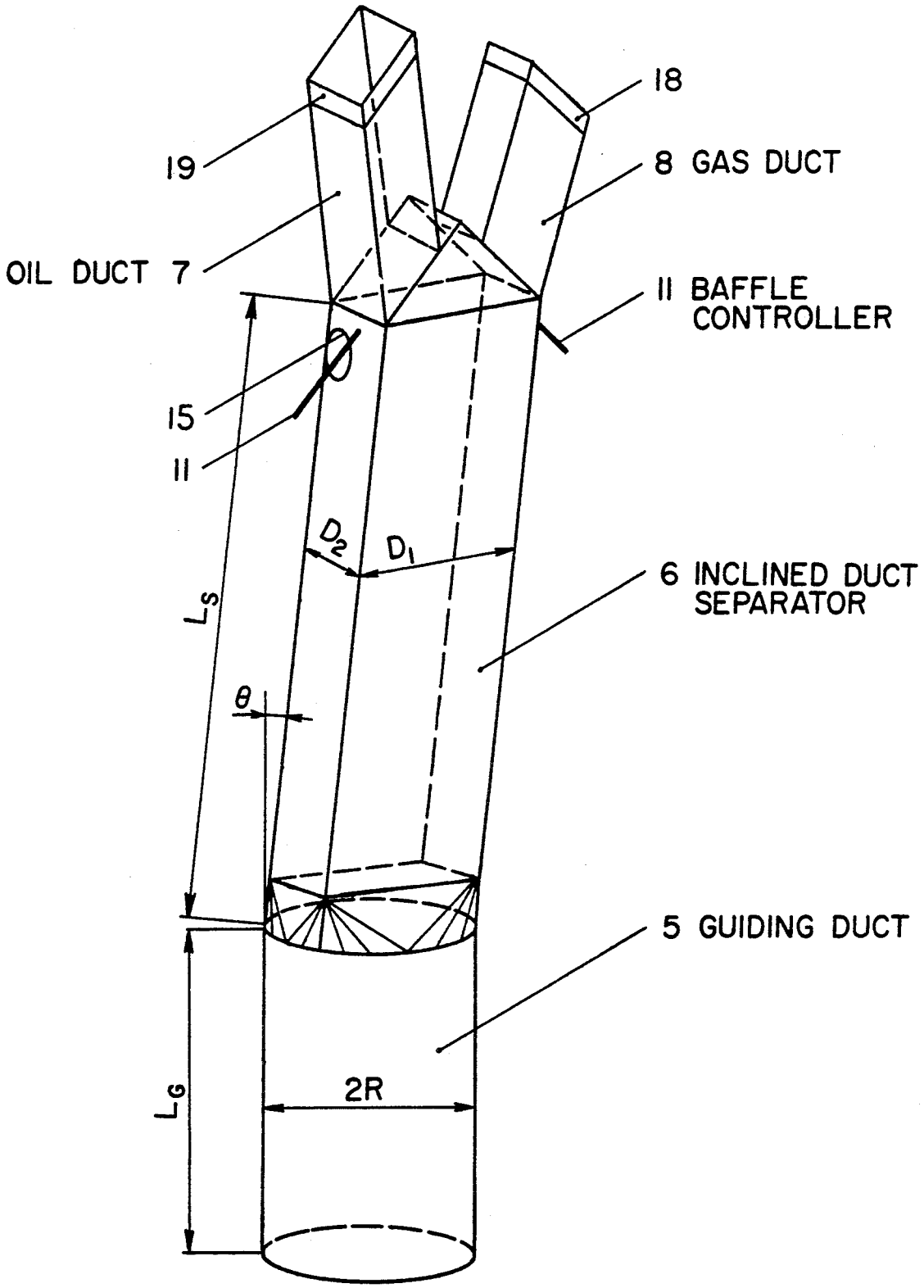
FIG. 3 shown the practical embodiment of the apparatus for extinguishing the oil well fires. The figure illustrates the relative proportions of different dimensions of the device and the locations of diverting ducts and baffle controllers.
Figure 4:
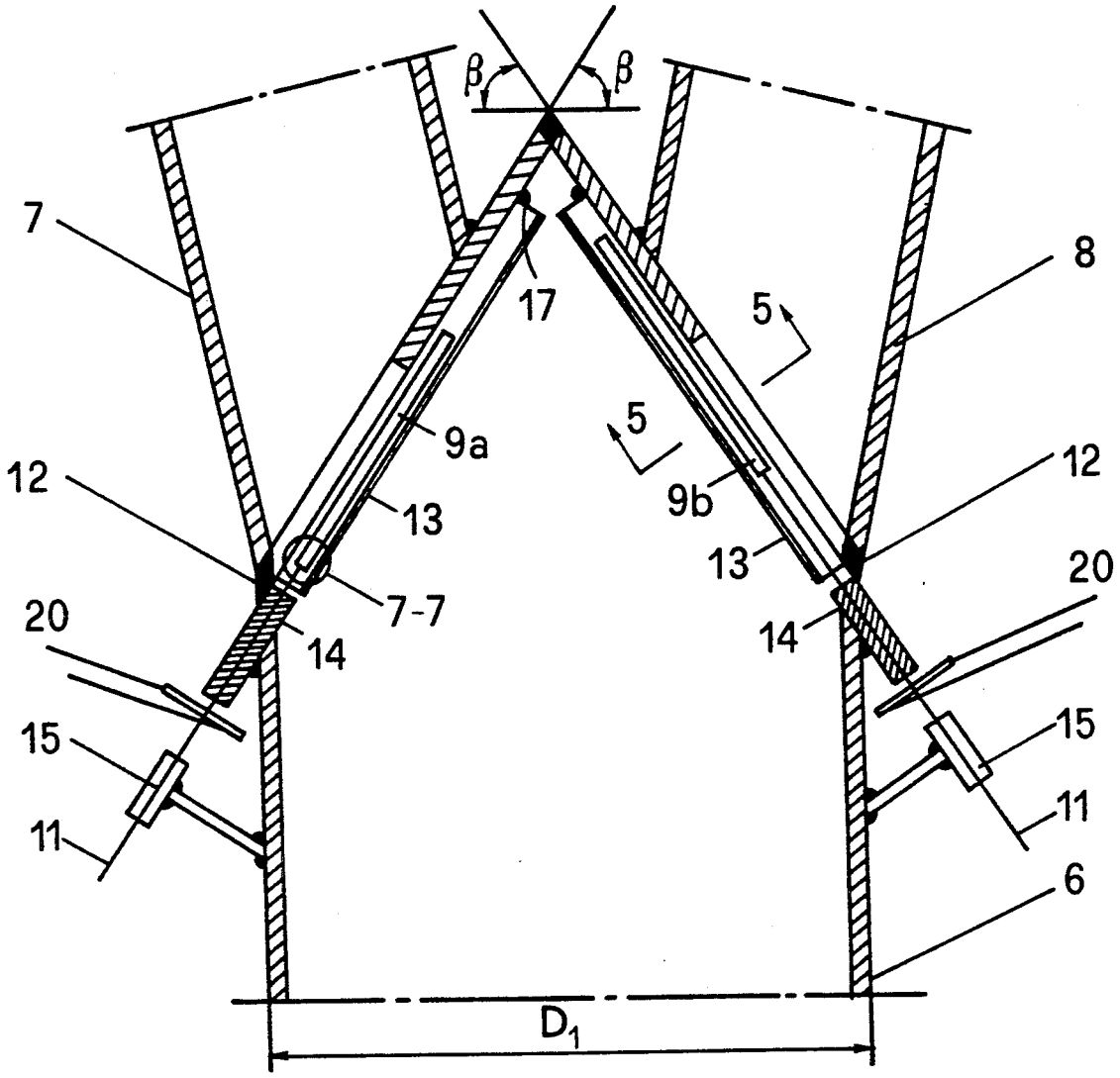
FIG. 4 illustrates a particular design of the baffle arrangement at the end of the inclined or separator duct and a method of controlling the opening and closing of the oil and gas ducts.
Figure 5:
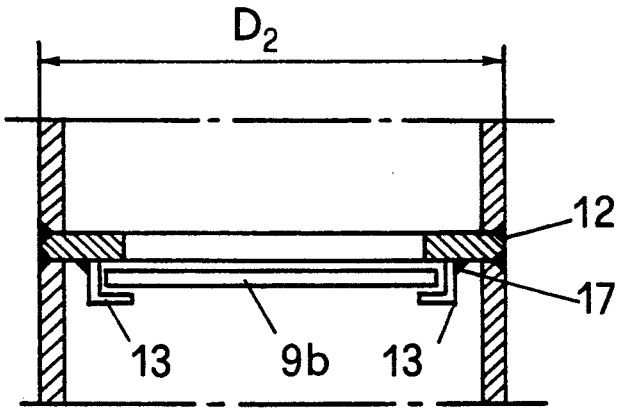
FIG. 5 shows a cross-sectional view taken at line 5—5 in FIG. 4 illustrating a detailed view of the sliding baffle arrangement.
Figure 6:
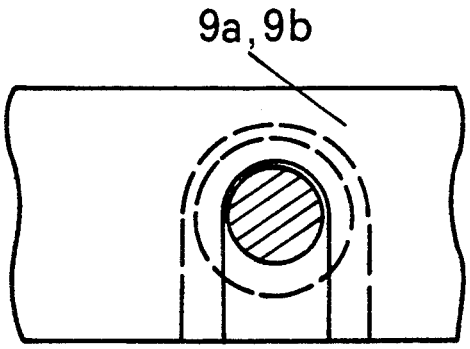
FIG. 6 shows a detailed cross-sectional view taken along line 6—6 in FIG. 7 of the shafts which provide the motion or control of baffles.
Figure 7:
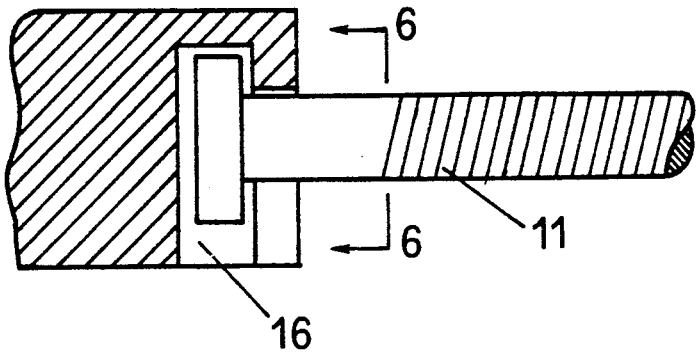
FIG. 7 shows a detailed cross-sectional view of detail 7—7 in FIG. 4.

A practical embodiment of the invention for extinguishing the oil well fires is illustrated in FIG. 3. The invention consists of a guiding duct 5 of length $L_G$ which is sufficiently wide to fully cover a burning well close to the ground and of an inclined or separator duct 6 attached to the duct 5. The separator duct 6 of length $L_S$ is inclined to the duct 5 or vertical by an angle $\phi$. The end of the inclined duct 6 is supplied with suitably arranged internal baffles controlled externally by shafts 11 and pulleys or motors 15 which serve the purpose of opening and closing the oil and gas flows through the diverting ducts 7 and 8. A particular design of the internal baffle arrangement is illustrated in FIGS. 4–7. This design consists of baffles 9*a* and 9*b* which can open and close oil and gas flows into the ducts 7 and 8. These baffles are controlled or moved along the guides 13 by turning the threaded shafts 11 by pulleys 20 or motors 15 through the guides 14 secured or welded to the duct 6. As shown in FIG. 7, the shafts 11 are inserted through the grooves 16 cut into the baffles 9*a* and 9*b*. Once assembled, the baffles are secured into the place by the guides 13 (see FIGS. 4 and 5). The guides 13 are simple "L" shaped iron frames which are secured by welds 17 to the inclined duct. The baffle arrangement with diverting ducts 7 and 8 is simply constructed from steel plates and assembled by welds 12 and 17.

When the baffle 9*a* is closed and 9*b* open, the two-phase flow mixture is discharged through the duct 8 into the atmosphere and is the starting point in the fire extinguishing process after the device has been lowered over a burning well. In this position the flame will be observed at the exit of duct 8 and can be gradually diminished by opening the baffle 9*a*. As the baffle 9*a* is opened and the oil stream diverted into the duct 7, the baffle 9*b* is gradually closed and the entire apparatus lowered onto the ground to prevent oxygen or air from being supplied into the reaction zone. The air inflow into the duct 8 can be eliminated by supplying this duct with a check valve 18. The oil duct 7 should also be equipped with a valve 19 to insure that the exiting oil covers the entire cross-sectional area of the duct, thus preventing the air inflow into the apparatus and allowing for the fine tunning of the fire extinguishing process.

The angle $\theta$ of inclination of the separator duct 6 can be optimized for minimal pressure losses in the system when oil is diverted through the duct 7. This angle is about 10 degrees but practically it should be increased to insure that all the oil in the guiding duct 5 hits the upper surface of the duct 6 and to allow for practical lengths of the inclined duct. Taking the diameter and length of the duct 5 to be $2R=0.5$ meters and $L_G=3$ meters, it follows that the guiding duct should be at least $L_s=2R/\sin\theta=3$ meters long for 10 degrees inclination, and 1.5 meters long for 20 degrees inclination. For a 0.5 meter diameter guiding duct and 20 degrees inclination, the duct 6 should be from 2–5 meters long with its shorter side collecting the oil. The wide side of the duct 6 can be set to $D_1=0.75(2R)$ and the shorter side to $D_2=0.3(2R)$ to insure an effective collection of oil. A large oil jet velocity through the separator has a tendency to increase the separator efficiency. The guiding duct 5 does not have to be circular but the inclined duct 6 will function more effectively as proposed, for otherwise it will be difficult to collect the oil efficiently and design the baffles for separating the two phases. The ducts 5 and 6 should be constructed from stainless steel plates 5–10 mm in thickness and welded. The guiding duct 5 should also be equipped with supports to secure the apparatus on a bulldozer or crane which may be used for lowering and holding the device in place during the fire fighting process. The pulleys 20 turning the shafts 11 for opening and closing baffles 9*a* and 9*b* can be controlled remotely through chains, or the shafts 11 can be equipped with motors 15 with a remote controller, thus eliminating the need of having fire fighting personnel stationed in the vicinity of the apparatus during the fire extinguishing process. The angle of inclination $\beta$ in FIG. 4 should be about 60 degrees to minimize the reaction forces on the apparatus and for allowing the separation and smooth flow of oil out of the device.

The apparatus in FIG. 3 can also be used after the flame has been extinguished for diverting the oil stream to a holding tank during the process of capping the well with a valve. To prevent buildup of excessive surface temperatures on the metal plates of the apparatus during fire fighting, the apparatus should be sprayed with water or the heat transfer surfaces of the apparatus designed with cooling passages. The former design is more robust, while the latter design may be preferable for regions lacking a sufficient water supply.

I claim:

1. An apparatus for extinguishing an oil well fire on an oil well releasing oil and gas, the apparatus comprising a guiding duct which covers at one end thereof the fire close to a ground surface; separator means attached at one end thereof to another end of the guiding duct for separating the oil from the gas into separate oil and gas streams, wherein the separator means comprises an inclined duct inclined with respect to vertical; and adjustable baffle means attached at another end of the separator means for diverting the separate oil and gas streams into separate ducts.

2. The apparatus of claim 1 wherein the ducts are of different cross-sectional geometry and lengths and the separator means is inclined at an angle with respect to the vertical.

3. The apparatus of claim 1 wherein the baffle means comprises one or more internal baffles, with the baffles sliding along guides secured to the inclined duct and adjusted by pulleys or motors.

4. The apparatus of claim 1 wherein the ducts carrying the separate oil and gas streams are equipped with check and flow control valves for a purpose of safely disposing the oil and gas streams.

* * * * *